US006576307B2

(12) United States Patent
Otsu et al.

(10) Patent No.: US 6,576,307 B2
(45) **Date of Patent: *Jun. 10, 2003**

(54) INCLUSION PACKAGED PRODUCT AND PREPARATION OF THE SAME

(75) Inventors: Kyoichi Otsu, Hyogo (JP); Naoko Yamashita, Hyogo (JP); Yoshiji Okumura, Osaka (JP); Toshio Miyake, Okayama (JP)

(73) Assignee: Kabushiki Kaisha Hayashibara Seibutsu Kagaku Kenkyujo, Okayama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/980,289

(22) Filed: Nov. 28, 1997

(65) Prior Publication Data

US 2001/0051235 A1 Dec. 13, 2001

(30) Foreign Application Priority Data

Nov. 29, 1996 (JP) ..... 8-333057

(51) Int. Cl.[7] ..... B32B 31/06

(52) U.S. Cl. ..... 428/35.7; 424/435; 206/823; 206/828; 428/42.2; 428/336

(58) Field of Search ..... 428/35.7, 70.1, 428/40.2, 42.2, 336, 905, 195; 604/358; 206/812, 823, 828; 424/435

(56) References Cited

U.S. PATENT DOCUMENTS

| | | | | | |
|---|---|---|---|---|---|
| 4,420,518 | A | | 12/1983 | Progar | 428/40 |
| 4,782,647 | A | | 11/1988 | Williams | 53/454 |
| 4,938,951 | A | * | 7/1990 | Leung et al. | 424/59 |
| 5,037,139 | A | * | 8/1991 | Schoenleber et al. | 283/56 |
| 5,391,420 | A | * | 2/1995 | Bootman et al. | 428/195 |
| 5,664,677 | A | * | 9/1997 | O'Connor | 206/494 |
| 5,857,564 | A | * | 1/1999 | Hymowitz | 206/209 |

FOREIGN PATENT DOCUMENTS

| | | |
|---|---|---|
| EP | 0 525 530 A2 | 2/1993 |
| EP | 0 744 341 A1 | 11/1996 |
| JP | 05-236885 | 9/1993 |

OTHER PUBLICATIONS

Merriam Websters Dictionary, 10th Edition, p. 65, 1998.*
Hawley's Condensed Chemical Dictionary, edited by Lewis, p. 305–06, 1997.*

* cited by examiner

*Primary Examiner*—Harold Pyon
*Assistant Examiner*—Sow-Fun Hon
(74) *Attorney, Agent, or Firm*—Browdy and Neimark PLLC

(57) ABSTRACT

An easily-handleable inclusion packaged product having thin-leaf inclusion articles which are prevented from contacting with external atmosphere to give a satisfactorily sanitation. The product can be produced by the steps of (1) coating a solution of an inclusion article on a base sheet, (2) drying the coated solution, and (3) sealing prescribed sections of the base sheet and an overlapping sheet by laminating the overlapping sheet on the base sheet to surround the area coated with the solution.

10 Claims, 3 Drawing Sheets

INCLUSION PACKAGED PRODUCT AND PREPARATION OF THE SAME

BACKGROUND OF THE INVENTION

1. Field of the Invention

The present invention relates to an inclusion packaged product and a process for producing the same, more particularly, to an inclusion packaged product that encloses a thin-leaf article with a sheet-like material, and a process for producing the same.

2. Description of the Prior Art

Recently, laminated cachous have become popular. For example, as disclosed in Japanese Patent Kokai No. 236, 885/93, conventional cachous are prepared by shaping compositions, which contain along with polysaccharides with a satisfactory membrane-formability, viscous stabilizers, plasticizer, flavors, sweeteners, substances with acid or sourness, and extracts, into sheet-like products, and cutting the sheet-like products into thin-leaves. The cachous thus obtained are packaged into containers in a prescribed number of leaves, then supplied for users. Such cachous are, however, relatively-small in size and easily stuck together so that they should be packaged by hand one by one in containers while counting, resulting in an increase of the production cost.

Not restricted to cachous, it is widely tried to shape products into thin-leaf forms in the food, cosmetic, and pharmaceutical fields. These thin-leaf products are easily handleable and transportable for users, and can be advantageously used in any numbers of leaves wherever one is, i.e., independently of indoors and outdoors, by taking them out from containers. From the producers' standpoint, however, there still exists a troublesome difficulty in handling the above products during their packaging even if they are shaped into thin-leaf products similarly as in cachous. In some cases, the products are even supplied to users without substantially being packaged to lower the increase of their production costs.

The output of the above thin-leaf products directly reflects today's diversified consuming-life-style. There has been a great demand for a packaging technique for thin-leaf products that fulfills user's needs and ensures satisfactory hygiene and handleability.

SUMMARY OF THE INVENTION

In view of the foregoing, the first object of the present invention is to provide an inclusion packaged product containing a thin-leaf inclusion article which has a satisfactory handleability and is protected from contact with the atmosphere.

The second object of the present invention is to provide a process for producing such an inclusion packaged product at a relatively-low production cost.

The present inventors' energetic study revealed that the above objects can be solved by an inclusion packaged product comprising an inclusion cell formed by a base sheet and an overlapping sheet, and a thin-leaf inclusion article enclosed in the inclusion cell in a manner such that it can be freely detached from the base sheet.

The first object of the present invention is solved by an inclusion packaged product comprising an inclusion cell formed by a base sheet and an overlapping sheet, and a thin-leaf inclusion article enclosed in the inclusion cell in a manner that it can be freely detached from the base sheet.

The second object of the present invention is solved by a process for producing the inclusion packaging product, which comprises the steps of: (1) coating a base sheet with a solution of an inclusion article, (2) drying the coated solution, and (3) placing an overlapping sheet on the base sheet and sealing prescribed sections of the sheets to surround the area coated with the solution.

BRIEF DESCRIPTION OF THE ACCOMPANYING DRAWINGS

Figure 1:
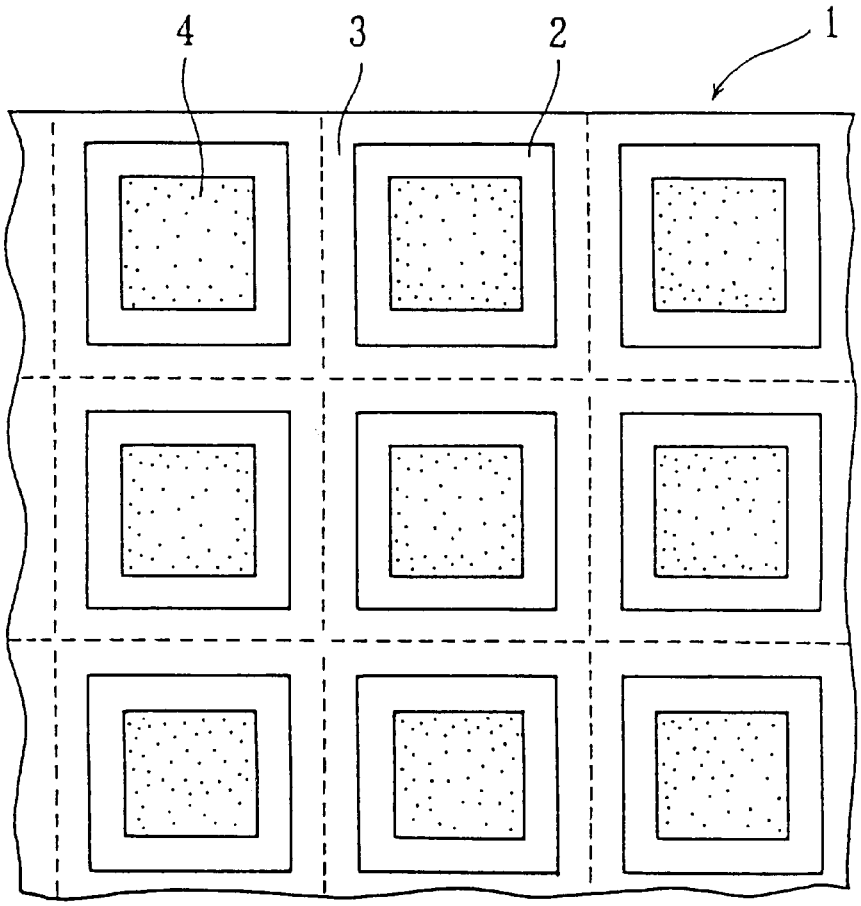
FIG. 1 is the plan view of the inclusion packaged product according to the present invention.

Throughout the figures, the reference numeral "1" shows inclusion packaged product; "2", inclusion cell; "3", sealed section; "4", thin-leaf inclusion article; "5", base sheet reservoir roll; "6", base sheet; "7", "8" and "9", sending rolls; "10", product-winding roll; "11", coating roll; "12", reservoir tank; "13", projection; "14", dryer; "15", reservoir roll for overlapping sheet; "16", overlapping sheet; and "17", sealing machine.

DETAILED DESCRIPTION OF THE INVENTION

Figure 2:
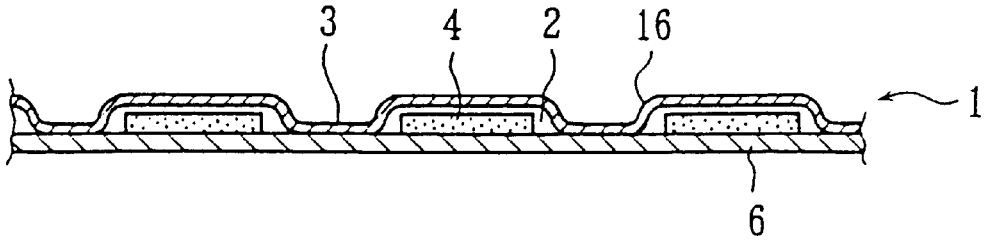
FIG. 2 is a longitudinal side elevation view of the inclusion packaged product according to the present invention.

Now explaining preferred embodiments according to the present invention with reference to the accompanying drawings, FIGS. 1 and 2 are respectively a plan view and a longitudinal side elevation view of the inclusion packaged product according to the present invention. In these figures, the reference numeral "1" shows the present inclusion packaged product; the reference numeral "2", an inclusion cell; the reference numeral "3", a sealed section; the reference numeral "4", a thin-leaf inclusion article; the reference numeral "6", a base sheet; and the reference numeral "16", an overlapping sheet. As evident from FIG. 2, inclusion cell 2 is formed by overlapping base sheet 6 and overlapping sheet 16 together, and sealing prescribed sections of the sheets by a technique such as heat sealing to form sealed section 3. The sealing around inclusion cell 2 enables articles packed therein to be shielded from contact with the atmosphere. Although, base sheet 6 and overlapping sheet 16 in FIG. 2 are separately prepared and provided as two sheets, inclusion cell 2 may be formed by folding one sheet into two sheets, i.e., one for base sheet 6 and the other for overlapping sheet 16, and sealing prescribed sections of the sheets. The sealing technique is not restricted to heat sealing, but it can be any technique including using adhesives or ultrasonics. Alternatively, adhesion, melting, deposition, and fixing can also be appropriately chosen depending on the materials used for the base and overlapping sheets. In the inclusion packaged product 1 according to the present invention, the number of inclusion cells 2 for enclosing inclusion articles is not specifically restricted. Thus one or more numbers of inclusion cells 2 can be arranged in a row or rows. Preferably, with a viewpoint of production cost, at least three inclusion cells 2 should be respectively provided vertically and horizontally on base sheet 6 at prescribed intervals. Such an arrangement can be easily feasible by the later described present process. For the sake of actual use, sealed section 3 provided around inclusion cell 2 is usually formed to give a considerable width and can be provided with perforations to facilitate cutting as shown by the broken lines in FIG. 1. Notch and depth of cutting, not shown in the figure, can be provided to facilitate the cutting of base sheet 6 and overlapping sheet 16. Alternatively, base sheet 6 and overlapping sheet 16 can be processed to be easily cut in a prescribed direction. As shown in FIG. 2, thin-leaf inclusion article 4 is enclosed within inclusion cell 2 in a manner that it can be freely detached from base sheet 6. Inclusion article 4 is usually placed in inclusion cell 2 one by one so that it can be processed to give a size slightly smaller than that of the inclusion cell 2. As described later, inclusion article 4 can be formed by coating base sheet 6 with a solution of inclusion article 4 to allow the inclusion article 4 to adhere to base sheet 6 normally in an adhesion strength level of being easily detached by users' fingertips.

Base sheet 6 and overlapping sheet 16 are usually made of moisture-proof and thermostable materials such as sheets of synthetic polymers, semisynthetic polymers, and natural polymers. The types of the polymers are not specifically restricted, but preferred are those which can be used in the food, cosmetic, and pharmaceutical fields. Examples of such polymers are polyethylene, polypropylene, ethylene acetate vinyl polymer, polyvinyl acetate, polyvinyl chloride, polyvinylidene chloride, polytetra-fluoroethylene, polyvinylidene fluoride, polystyrene, polyacrylonitrile, polyacrylate, polymethacrylic acid, ethylene polypropylene copolymer, ethylene/acrylic acid copolymer, ethylene/acrylic acid methyl copolymer, propylene vinylchloride copolymer, ethylenevinyl alcohol copolymer, polyethylene terephthalate, polybutylene terephthalate, polycarbonate, nylon, normal cellophane, moistureproof cellophane, cellulose acetate, carboxymethyl cellulose, polyvinyl alcohol, hydrochlorinated rubbers, papers, and aluminum foil. If necessary, these polymers can be appropriately used in combination by laminating or treated with opaque and coloration treatments before use. The thickness of the sheets is not specifically restricted, and the thickness can be appropriately selected depending on purposes. Nevertheless, to facilitate the process, in the case of applying the later described process according to the present invention, base sheet 6 and overlapping sheet 16 are preferably processed to give an equal thickness of about 1–100 $\mu$m, more preferably, about 10–50 $\mu$m, or the base sheet can preferably be processed to give a thickness which is thicker than the overlapping sheet.

Thin-leaf inclusion article 4 can be prepared by using, as bases, water-soluble polymers, preferably, polysaccharides, having a satisfactory water-solubility and membrane-formability, usable in food products, cosmetics, and pharmaceuticals. Examples of such water-soluble polymers are amylose, gum arabic, sodium alginate, elsinan, curdlan, carrageenan, karaya gum, agar, xanthan gum, chitin, guar gum, quince seed gum, mannan, gelatin, cellulose, tamarind gum, dextran, starches, tragacanth gum, pectin, pullulan, polyvinyl alcohol, locust bean gum, and derivatives thereof. These water-soluble polymers can be arbitrarily used in combination. Among these polymers, gum arabic, dextran, and pullulan are preferably used because of their superior water-solubility and membrane-formability. More particularly, the use of pullulan enables the production of inclusion packaged products with a satisfactory flexibility, transparency, and quality.

The types and proportions of the ingredients of inclusion article 4 are varied depending on their purposes. When applying the present invention to food products, the following ingredients can be used in adequate amounts after being pulverized as needed: Seasonings such as sodium inosinate, sodium guanylate, sodium glutamate, soy sauces, misos, sauces, sakes, foreign wines, mirins, vinegars, and salts; extract seasonings such as yeast extracts, meat extracts, fish meat extracts, vegetable extracts, fruit extracts, seaweeds' extracts, and propolises; acids such as adipic acid, citric acid, δ-D-gluconolactone, gluconic acid, acetic acid, tartaric acid, succinic acid, lactic acid, and malic acid; sweeteners such as hydrangea, glycyrrhizin, stevioside, rebaudioside, peptide sweetener, saccharin, and cyclamate; flavors such as origanum oil, grape fruit oil, sweet orange oil, davana oil, Japanese mint oil, vanilla oil, hyssop oil, bitter almond oil, bitter orange oil, pepper mint oil, perilla, mandarin oil, lemon oil, and rose oil; seasonings such as cassia, capsicum, cumin, clary sage, coriander, cinnamon, ginger, thyme, nutmeg, pepper, and mustard; and food materials such as processed- or unprocessed meats, fish meats, vegetables, fruits, seaweeds, and mushrooms. When using oil-soluble flavors, they can be previously emulsified in a conventional manner before use. In the cause of applying the present invention to pharmaceuticals, the following pharmaceutically-acceptable ingredients can be used in adequate amounts: Anodynes/antiphlogistics such as acetaminophen, phenacetin, aspirin, aminopyrine, dipyron, oxyphenbutazone, phenylbutazone, mefenamic acid, flufenamic acid, diclofenac, alclofenac, ibuprofen, flurbiprofen, salicylic acid, methyl salicylate, menthol, camphor, sulindac, sodium tolmetinate, naproxen, fenbufen, indomethacin, and colchicine; antiphlogistic enzymes such as α-chymotrypsin; antiphlogistic steroids such as hydrocortisone, prednisolone, triamcinolone, dexamethasone, and betamethasone; antihistamines such as diphenhydramine hydrochloride and dexchlorpheniramine maleate; antibiotics and germicides such as tetracycline, leucomycin or kitasamycin, fradiomycin, penicillin, and derivatives thereof, cephalosporin derivatives, chloramphenicol, fradiomycin and derivatives thereof, and erythromycin; chemotherapeutic agents such as sulfathiazole and nitrofurazone; anaesthetics such as lidocaine and benzocaine; cardiacs such as digitalis and digoxin; vasodilators such as nitroglycerin and papaverine hydrochloride; antitussives and expectorants such as codeini phosphas and isoproterenol sulfate; oral bactericides such as chlorhexidine hydrochloride, 4-hexyl resorcinol, and ethacridine; drugs for digestive organs such as pepstatin, azulene, phenovalin, and methylmethionine sulfonium chloride; hypoglycemic agents such as insulin; and other drugs such as hemostatics, hypotensive agents, sedatives, anti-verigeneous drugs, antitumor agents, crude drug extracts, and vitamins. When using the above ingredients, they are satisfactorily placed in each cell 2, provided in inclusion packaged product 1, after being formed into thin-leaf inclusion articles which contain sufficient amounts of the ingredients in a unit dose form or a divisor dose form with respect to each ingredient. The pharmaceuticals thus obtained can be administered to humans via peroral, intubation, percutaneous, and permucosal administrations to treat and/or prevent diseases.

Alternative ingredients to be incorporated in inclusion article 4 include cosmetically-acceptable ingredients such as foundations, rouges, eye shadows, eye brow coloring agents, pearl color compounds, basal creams, agents for growth and regeneration of hair, and bath salts, i.e., cosmetic colors, crude drug extracts, ultraviolet-absorbing agents, and skin-beautifying ingredients, flavors, and ingredients for growth and regeneration of hair. The present invention can be arbitrarily used in agricultural fields including for plant seeds, fertilizers, pet foods, and feeds.

As described above, the inclusion packaged product according to the present invention can be widely applicable to food product, cosmetic, and pharmaceutical fields, etc. In any case, to stabilize the ingredients, improve the property of the thin-leaf inclusion articles, and control the releasing strength of the inclusion articles from the base sheet, the following ingredients can be used in combination with the above ingredients; viscosity-imparting agents such as oligosaccharides and dextrins; humectants such as glycerine, xylitol, sorbitol, propylene glycol, sodium lactate, sodium pyrrolidone carbonate, polyethylene glycol, carboxymethyl cellulose, alginic acid, serine, maltitol, galactosamine, soluble collagen, elastin, sodium hyaluronate, chondroitin sulfate, and aspartic acid; surfactants such as sucrose fatty acid ester, maltose fatty acid ester, maltitol fatty acid ester, trehalose fatty acid ester, and fatty acid glycerol ester; and others such as emulsifiers, colorants, stabilizers, antioxidants, preservatives, and germicides. Inclusion articles with printed pictures using adequate colorants can be arbitrarily used as "TRANSFER-SHEET" for printing pictures on food products, etc.

The inclusion packaged product according to the present invention can be produced by a variety of methods; usually it can be produced by forming a thin-leaf inclusion article on the base sheet, laminating an overlapping sheet on the base sheet, and sealing the adequate sections of the sheets; a solution containing about 10–50 w/w % of any of the above water-soluble polymers, preferably, about 20–40 w/w %, is prepared, then mixed with one or more ingredients depending on purposes. Varying depending on the types and uses of the ingredients, incorporation of excessive amounts of the ingredients may lower the flexibility and/or solubility of thin-leaf inclusion articles so that ingredients, that exert a satisfactory activity with only a small amount, preferably are incorporated in the solution in an amount as low as possible; usually in an amount of not higher than about 40%, preferably, not higher than 30% of the water soluble polymer used, on a dry solid basis (d.s.b.). These ingredients are not necessarily be dissolved; they may be in suspension forms as solids with sizes that do not hinder the formation of thin-leaves. The solutions for inclusion articles thus obtained can be intermittently coated on a plurality of sections on the base sheet at prescribed intervals, and dried at temperatures above ambient temperature, usually, about 40–100° C., preferably, about 60–90° C., into thin-leaf inclusion articles. An overlapping sheet is laminated on either side with the thin-leaf inclusion articles formed on the base sheet, and then the inclusion articles are enclosed in inclusion cells, formed between the base sheet and the overlapping sheet, by sealing prescribed sections of the sheets to surround the articles and to be freely detachable by a technique such as heat sealing. The thickness of the thin-leaf inclusion articles can be varied depending on purposes and easily controlled within the range of about 10–500 $\mu$m, preferably, about 10–100 $\mu$m, by appropriately changing the concentration of water-soluble polymers and the coating rate of the solutions, etc. The above inclusion packaged product with a satisfactorily high-quality is continuously produced by applying the present process at a lowest possible cost and labor. The present invention will be explained with reference to FIG. 3.

Figure 3:
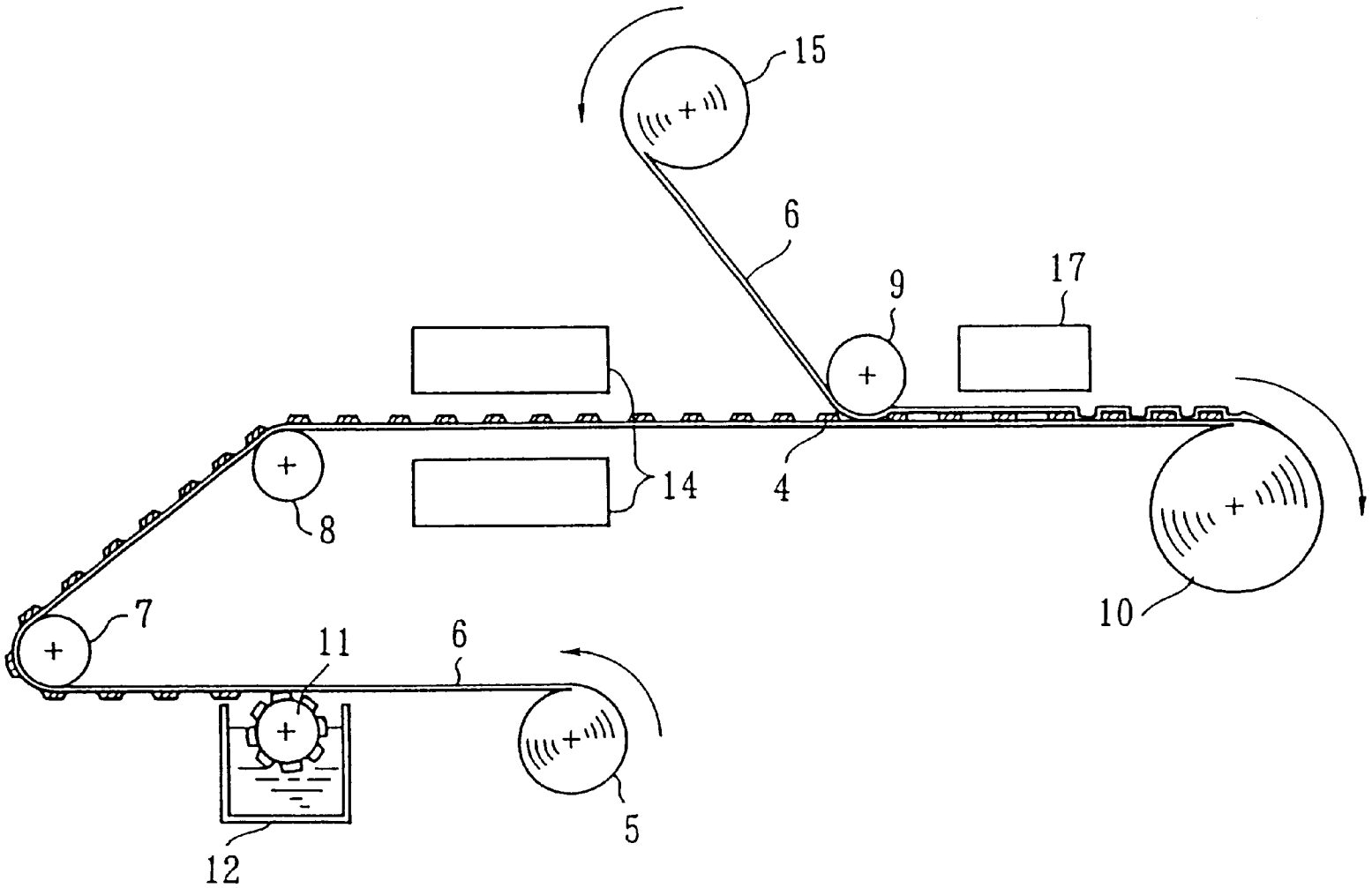
FIG. 3 is a production scheme of the process according to the present invention.
Figure 4:
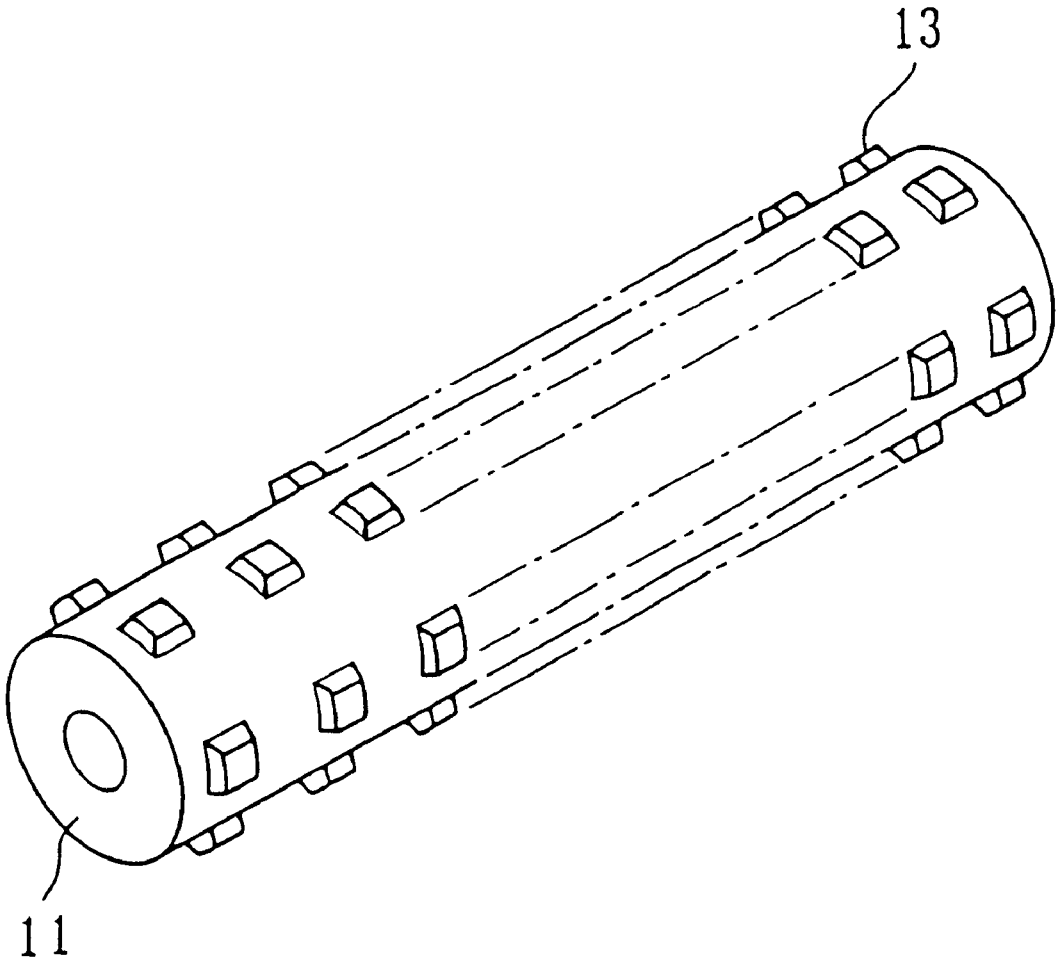
FIG. 4 is a squint view of a coating roll usable in the present invention.

In FIG. 3, the reference numeral "5" is a base sheet reservoir roll, and base sheet 6 is transported from base sheet reservoir roll 5 to product-winding roll 10 via sending rolls 7, 8 and 9. The reference numeral "11" is a coating roll used for intermittently coating a solution of inclusion article 4, contained in reservoir tank 12, on base sheet 6 at prescribed intervals. As shown in FIG. 4, coating roll 11 has a structure of conventional roll provided with projections 13 around the roll, and the rotation of coating roll 11 allows it to intermittently coat a solution of an inclusion article, adhered to the edges of projections 13, on prescribed sections of the base sheet 6 while base sheet 6 is being sent out. The reference numeral "14" is a dryer used for drying the solution, coated on base sheet 6, with hot air or far infrared rays. The reference numeral "15" is a reservoir roll for overlapping sheet, and from which overlapping sheet 16 is sent out via roll 9 to be laminated on the upper side of base sheet 6. The reference numeral "17" is a sealing machine such as heat sealer used for sealing appropriate sections of base sheet 6 and overlapping sheet 16 to enclose thin-leaf inclusion article 4 in inclusion cell 2, formed between base sheet 6 and overlapping sheet 16, in a manner that the inclusion article 4 can be freely detached. The inclusion packaged product thus obtained is wound by product-winding roll 10. The wound product is cut to give desired sizes depending on purposes. The production scheme of FIG. 3 is only an example of a roller coating using coating roll 11, and the present process should not be restricted to the coating; other conventional coating methods such as gravure coating, bar coating, air-knife coating, screen coating, etc., can be employed in the present invention. Referring to coating roll 11 in FIG. 4, a plurality of rows of projections 13 are provided, however, the number of rows can be appropriately changed on demands.

The following examples explain the present invention in more detail:

EXAMPLE 1

| Cachou | |
|---|---|
| Ingredients | Content (part by weight) |
| Pullulan | 19.2 |
| Locust bean gum | 1.2 |
| Glycerin | 0.1 |
| Sorbitol | 0.8 |
| Dextrin (DE 25) | 3.8 |
| Water | 71.0 |
| Emulsified Japanese mint oil | 3.0 |
| "ASPARTAME", a synthetic peptide sweetener commercialized by Ajinomoto Co. Ltd., Tokyo, Japan | 0.3 |
| Citric acid | 0.3 |
| Sucrose fatty acid ester | 0.3 |

An aqueous solution consisting of the above ingredients was prepared and poured into reservoir tank 12 in FIG. 3, and polyethylene sheets 1.1 m wide, 30 and 10 $\mu$m thick, as base sheet 6 and overlapping sheet 16, respectively, were set to a roller coating machine and moved at a rate of 7 m/min. A hot-air-blowing-type dryer was used as dryer 14, and air heated to 80° C. was blown into the contents from the lower and upper sides of base sheet 6. The edge of projection 13 on coating roll 11 was shaped to form a thin-leaf inclusion article 4, with a size of 20×30 mm after drying, formed on base sheet 6. Thus, it was obtained a relatively-wide-and-long inclusion packaged product with regularly repeating rows of 27 inclusion cells, that enclose thin-leaf cachous, about 30 $\mu$m thick, spaced one centimeter apart and placed at regular intervals of about one centimeter as a sealed section in the width direction of base sheet 6.

In this product, the thin-leaf inclusion cachous are distributed to inclusion cells 2, formed between base sheet 6 and overlapping sheet 16. You can enjoy a refreshing flavor and sweetness throughout your mouth by taking out them from the product and placing them in your mouth. The inclusion packaged product can be cut to give an appropriate size, for example, cut into about one to ten sets of inclusion cells, which can be easily curled or folded for ease of carrying in one's bags and pockets, and one can freely take out and taste them even in front of others so that one can prevent disagreeable mouth-odor and refresh your feeling without offending public manners and etiquettes in public places.

EXAMPLE 2

| Sweetener | |
|---|---|
| Ingredients | Content (part by weight) |
| Pullulan | 25.0 |
| "ASPARTAME", a synthetic peptide sweetener commercialized by Ajinomoto Co., Ltd., Tokyo, Japan | 4.0 |
| Sucrose fatty acid ester | 1.0 |
| Water | 70.0 |

Similarly as in Example 1 except for using both the aqueous solution consisting of the above ingredients and polypropylene sheets, 30 $\mu$m thick and 1.1 m wide each, as base sheet 6 and overlapping sheet 16 in FIG. 3, there was obtained a relatively-wide-and-long inclusion packaged product with regularly repeating rows of 27 inclusion cells, that enclose thin-leaves with sweeteners, about 50 $\mu$m thick and 20×20 mm each, spaced one centimeter apart and placed at regular intervals of about one centimeter as a sealed section in the width direction of base sheet 6.

The inclusion packaged product, enclosing distributed thin-leaves with sweeteners, can sweeten a cup of coffee with only a piece of thin-leaf enclosed in each inclusion cell. The product is easily handleable, and the thin-leaves are maintained out of contact with the atmosphere. Because of these, one can cut them into appropriate sizes and taste them even outdoors without any inconvenience.

EXAMPLE 3

| Seasoning | |
|---|---|
| Ingredients | Content (part by weight) |
| Powder of dried bonito flakes | 2.0 |
| Powder of parched sesame | 2.0 |
| Soy sauce | 1.0 |
| Pullulan | 19.0 |
| Sucrose fatty acid ester | 1.0 |
| Water | 75.0 |

A relatively-wide-and-long inclusion packaged product with regularly repeating rows of 15 inclusion cells, that enclose thin-leaves with seasonings, about 60 $\mu$m thick and 50×50 mm each, spaced one centimeter apart and placed at regular intervals of about one centimeter as a sealed section in the width direction of base sheet 6, was obtained similarly as in Example 1 except for using a homogeneously mixed suspension consisting of the above ingredients, and a Japanese paper, 1.1 m wide, laminated with polyethylene sheets, 30 $\mu$m thick, as base sheet 6 and overlapping sheet 16 in FIG. 3.

The thin-leaves inclosed in the inclusion packaged product have a satisfactory flexibility and folding endurance, and keep the color, gloss, flavor, and taste for a relatively-long period of time. Because of these properties, it can be suitably used as rolling materials for foods such as "onigiri" (a rice ball).

EXAMPLE 4

| Medicament | |
|---|---|
| Ingredients | Content (part by weight) |
| Aspirin | 1.0 |
| Pullulan | 15.0 |
| Mannan | 3.0 |
| Fatty acid glycerol ester | 1.0 |
| Water | 80.0 |

Similarly as in Example 1 except for using an aqueous solution consisting of the above ingredients, and polyacrylic acid sheets, 40 $\mu$m thick and 1.1 m wide each, as base sheet 6 and overlapping sheet 16 in FIG. 3, there was obtained a relatively-wide-and-long inclusion packaged product with regularly repeating rows of 22 inclusion cells, that enclose thin-leaves with aspirin, about 30 $\mu$m thick and 30×40 mm each, spaced one centimeter apart and placed at regular intervals of about one centimeter as a sealed section in the width direction of base sheet 6.

The inclusion packaged product gradually releases aspirin with an analgesic-antipyretic activity, and this prevents a rapid increase of the concentration of aspirin in the intestinal organs after the administration, and retains a satisfactory effect for a relatively-long period of time. In the product, a thin-leaf as a dose is physically separated from the atmosphere so that the product can be cut into appropriate pieces to optimize carrying convenience for use in the outdoors and on trips.

EXAMPLE 5

| Cosmetic | |
|---|---|
| Ingredients | Content (part by weight) |
| Pullulan | 4.2 |
| Gum arabic | 0.5 |
| Carrageenan | 0.1 |
| Water | 43.7 |
| Titanium oxide | 19.0 |
| Barium sulfate | 1.5 |
| Red iron oxide | 4.0 |
| Yellow iron oxide | 1.5 |
| Black iron oxide | 0.3 |
| Talc | 0.5 |
| Lecithin | 0.5 |
| Polyoxyethylene sorbitan monooleate (20 E.O.) | 0.2 |
| Propylene glycol | 11.0 |
| Dimethylpolysiloxane | 13.0 |

A relatively-wide-and-long inclusion packaged product with regularly repeating rows of 15 inclusion cells, that enclose thin-leaves with foundations, about 60 $\mu$m thick and 50×50 mm each, spaced one centimeter apart and placed at regular intervals of about one centimeter as a sealed section in the width direction of base sheet 6, was obtained similarly as in Example 1 except for using an aqueous solution consisting of the above ingredients, and polypropylene sheets, 20 μm thick and 1.1 m wide each, as base sheet 6 and overlapping sheet 16 in FIG. 3, and moving the sheets at a rate of 5 m/min.

The inclusion packaged product is easily transportable, sufficient in strength, and satisfactory in gloss, and it does not become sticky when touched with hands and maintains a smooth surface. When wiped with a moistened sponge, it easily dissolves and had a satisfactory handleability and waterproofing.

EXAMPLE 6

| Seed | |
|---|---|
| Ingredients | Content (part by weight) |
| Pullulan | 25.0 |
| Locust bean gum | 5.0 |
| Sucrose fatty acid ester | 1.0 |
| Parsley seed | 4.0 |
| Water | 65.0 |

A relatively-wide-and-long inclusion packaged product with regularly repeating rows of 15 inclusion cells, that enclose thin-leaves with the seeds, about 100 μm thick and 50×50 mm each, spaced one centimeter apart and placed at regular intervals of about one centimeter as a sealing area in the width direction of base sheet 6 was prepared similarly as in Example 1 except for using a suspension consisting of the above ingredients, polyethylene sheets, 30 μm thick and 1.1 m wide each, as base sheet 6 and overlapping sheet 16 in FIG. 3, dryer 14 as a hot-air-blowing-type dryer, and drying conditions of a relatively-low temperature.

The inclusion packaged product keeps a relatively-high germination percentage of the seeds for a satisfactorily-long period of time. Since the thin-leaves are packaged in the product, they are prevented from being melted by sweat when handled, and this facilitates the seeding work. Also the leaves are readily melted by water sprinkled after the seeding, resulting in exposure and germination of the seeds.

As described above, the present invention relates to a completely novel inclusion packaged product which is easily handled and transported. Since the thin-leaf inclusion articles packaged in the product do not contact the atmosphere, they have substantially no sanitary problem. The product is easily produced by the process according to the present invention.

The present invention with such an outstanding effect would significantly contribute to this art.

While there has been described what is at present considered to be the preferred embodiments of the invention, it will be understood that various modifications may be made therein, and it is intended to cover in the appended claims all such modifications as fall within the true spirit and scope of the invention.

We claim:

1. An inclusion product which comprises:

(i) an inclusion cell formed from a base sheet and an overlapping sheet, wherein the base sheet and the overlapping sheet each has a thickness of about 1–100 μm, and the thickness of the overlapping sheet is not greater than that of the base sheet, and (ii) a thin-leaf inclusion article, which dissolves or melts in water, comprising a water soluble polymer in the form of a thin film having a thickness of about 10–500 μm, wherein the thin film is produced by providing about 10–50 w/w% solution of the water-soluble polymer and at least one ingredient selected from the group consisting of foods, cosmetics, and pharmaceuticals; and wherein the water soluble polymer is selected from the group consisting of amylose, gum Arabic, sodium alginate, elsian, curdlan, carrageenan, karaya gum, agar, xanthan gum, chitin, guar gum, quince seed gum, mannan, gelatin, tamarind gum, dextran, starches, tragacanth gum, pectin, pullulan, locust bean gum, and derivatives thereof; depositing the solution onto a prescribed portion of the base sheet and then evaporating the solvent from the solution at a temperature of 40–100° C. to dry and form the thin-leaf inclusion article; and is obtained by:

placing the overlapping sheet over the thin-leaf inclusion article; and sealing appropriate sections of the overlapping sheet on the base sheet to create the inclusion cell to enclose the thin-leaf inclusion article which is adhered to the base sheet whereby the thin-leaf inclusion article is freely detachable from the base sheet, and is smaller than the inclusion cell.

2. The product according to claim 1, wherein a plurality of said inclusion cells are provided crosswise on said base sheet.

3. The product according to claim 1, wherein said inclusion cell is formed by sealing prescribed sections of said base sheet and said overlapping sheet facing each other.

4. The product according to claim 1, wherein said thin-leaf article is formed on said base sheet and is enclosed in said inclusion cell.

5. The product according to claim 1, wherein said inclusion article has a thickness of about 10–500 μm.

6. The product according to claim 1, wherein the thickness of said overlapping sheet is not thicker than that of said base sheet.

7. The product according to claim 1, wherein said base sheet and said overlapping sheet have a thickness of about 1–100 μm, respectively.

8. The product according to claim 1, wherein said base sheet and said overlapping sheet are made of one or more synthetic polymers, semisynthetic polymers, and natural polymers.

9. The product according to claim 1, wherein said polymers are members selected from the group consisting of polyethylene, polypropylene, ethylene acetic vinyl polymer, polyvinyl acetate, polyvinyl chloride, polyvinylidene chloride, polytetra-fluoroethylene, polyvinylidene fluoride, polystyrene, polyacrylonitrile, polyacrylate, polymethacrylic acid, ethylene polypropylene copolymer, ethylene acrylic acid copolymer, ethylene acrylic acid methyl copolymer, propylene vinylchloride copolymer, ethylenevinyl alcohol copolymer, polyethylene terephthalate, polybutylene terephthalate, polycarbonate, nylon, normal cellophane, moistureproof cellophane, cellulose acetate, carboxymethyl cellulose, polyvinyl alcohol, hydrochlorinated rubbers, papers, and aluminum foil.

10. The product according to claim 1, wherein said inclusion article contains a member selected from the group consisting of food-, cosmetic-, and pharmaceutical-ingredients.

* * * * *